United States Patent [19]

Carnahan

[11] Patent Number: 4,825,948

[45] Date of Patent: May 2, 1989

[54] REMOTELY VARIABLE MULTIPLE BORE RAM SYSTEM AND METHOD

[76] Inventor: David A. Carnahan, 15519 Dawnbrook Dr., Houston, Tex. 77068

[21] Appl. No.: 26,377

[22] Filed: Mar. 16, 1987

[51] Int. Cl.[4] ..... E21B 33/06; B23P 19/04

[52] U.S. Cl. ..... 166/277; 166/82; 166/85; 166/387; 29/235; 29/451; 251/1.3; 277/9.5

[58] Field of Search ..... 166/365, 373, 377, 378, 166/381, 887, 75.1, 82, 84, 85, 277, 76; 251/1.1, 1.2, 1.3; 277/9, 9.5, 10, 11, 73, 127, 192, 198, 199, 129; 29/451, 235

[56] References Cited

U.S. PATENT DOCUMENTS

| | | | |
|---|---|---|---|
| 2,427,073 | 9/1947 | Schweitzer | 277/129 |
| 3,272,222 | 9/1966 | Allen | 277/127 |
| 3,554,480 | 1/1971 | Rowe | 277/127 |
| 3,737,974 | 6/1973 | Mott | 29/235 |
| 3,741,296 | 6/1973 | Murman et al. | 251/1.1 |
| 3,821,838 | 7/1974 | Mott | 29/235 |
| 4,003,430 | 1/1977 | Carnahan | 166/85 |
| 4,133,342 | 1/1979 | Carnahan | 166/277 |
| 4,398,729 | 8/1983 | Bishop et al. | 251/1.3 |
| 4,541,639 | 9/1985 | Williams, III | 251/1.3 |

*Primary Examiner*—Bruce M. Kisliuk
*Attorney, Agent, or Firm*—Kenneth H. Johnson

[57] ABSTRACT

Method and apparatus for varying from a remote location the bore of shoes within a ram-type blow out preventer to sealingly engage pipe of varying diameters. A plurality of shoe pairs is provided, each pair defining a cylindrical surface having a different bore for engagement about pipe of corresponding diameter. Each shoe has pipe faces and a curved packer surface forming a semicircular half-cylinder portion of the cylindrical surface and is releasably and interchangeably interconnectable by a lock pin to either of a pair of rams in the preventer. Method and apparatus are further provided for effecting from a remote location removal of a first shoe pair from the preventer rams and transfer thereof to the location, as well as transfer of a second shoe pair from the location to the preventer and installation therein, thereby remotely varying the shoe bore in the preventer as desired.

3 Claims, 7 Drawing Sheets

A-A

REMOTELY VARIABLE MULTIPLE BORE RAM SYSTEM AND METHOD

FIELD OF THE INVENTION

This invention relates generally to blow out preventers for use with oil and gas wells, and, more particularly, relates to a system for modifying a ram type preventer from a remote location to permit sealing engagement of the preventer about pipe of varying diameters.

BACKGROUND OF THE INVENTION

In the drilling of oil or gas wells apparatus is employed to prevent such wells from blowing out of control during the drilling operations. Such apparatus conventionally comprises a plurality of devices known in the art as blow out preventers which are attached to the well head.

It is further conventional to provide at least two such preventers of the ram type, a typical example of one being manufactured by Cameron Iron Works and depicted on page 1435 of the Composite Catalog 1980–1981 published by World Oil. Such preventers typically include a pressure vessel housing enclosing hydraulically or mechanically actuated opposing pistons which are attached to corresponding ram blocks for puroses of urging the ram blocks in radial directions into and out of the wellbore. The ram blocks, in turn, carry faces of varying design, each having a semicircularly shaped sealing surface formed of a resilient packing material whereby when the faces are forced radially inwards by the pistons sufficiently, a cylindrical sealing surface of this resilient material is thereby formed for sealing engagement about pipe traversing the preventer bore and borehole. The closing of these ram blocks about the pipe thereby effectively seals off the preventer bore transversely about the pipe, thereby preventing undesirable escape of pressurized fluid from the wellbore.

During the drilling of hydrocarbon wells, it is necessary at various times to suspend pipe of varying outside diameters through these blow out preventers into the wellbore for purposes well known in the art. Accordingly, it is concomitantly necessary to change out the ram blocks in the preventers to accommodate these differing pipe diameters, inasmuch as for a given pair of ram blocks installed within a preventer, the radius of curvature of the sealing faces thereof define a single bore diameter adapted for sealing engagement only with pipe of a correlative outer diameter. Moreover, in order to accommodate the wide range of pipe diameters and provide correlative ram openings encountered in the art, which may typically range from $2\frac{3}{8}$ to $9\frac{5}{8}$ inches o.d., it has been conventional to disassemble the preventers and install different ram blocks with faces having sealing surfaces of a different radius of curvature to accomodate the o.d. of the particular pipe traversing the wellbore.

Unfortunately, the aforementioned blow out preventers are frequently disposed in inaccessible or hazardous locations as, for example, below the drilling rig floor, or, in the case of offshore wells, adjacent to the sea bed. It may thus be readily appreciated that such changing out of ram blocks to accomodate pipe of differing diameters is not only time consuming but frequently a dangerous and expensive operation. For example, in the case of the aforesaid preventers located on the ocean floor, as for example with a floating drilling rig, the change-out operation necessitates detaching the preventers and riser from the wellhead, lifting the preventers, which are frequently quite bulky and heavy, and their attached riser to the drilling rig, disassembling the preventers to remove the ram blocks, installing different blocks and reassembling and pressure testing the preventers, and thence returning the preventers and riser to the sea bed wellhead and reattaching them. Such operations are thus as stated extremely difficult, dangerous, time consuming and expensive, with several days of unproductive rig drilling down time being required to effect such changes.

For the foregoing reasons, methods and apparatus were long sought for effecting the modification of such preventers from remote locations to accomodate pipe of varying diameters. Thus, it has become known in the art as shown in U.S. Pat. Nos. 4,133,342 and 4,003,430 to provide various drill pipe conveyed mechanisms which were lowered proximally to the ram faces for cutting out and flushing away the resilient packing material carried by the ram blocks. Additional apparatus as shown in U.S. Pat. Nos. 3,737,974 and 3,821,838 has further been provided, also conveyed by the drill string, for transferring replacement seals from a remote location to the preventer and thence installing and securing such seals in the recess resulting from the previous operation of removing the pliable packer material in the rams.

While such technology has met with some success in certain applications, several problems were nevertheless still associated with attempts to effect the modification of ram shoe bores from a situs remotely of the preventer. For example, in the aforementioned approach, it will be recalled that one step comprised the cutting out and thus destruction of the prior packing material which was thus obviously not retrieved intact at the remote location. Moreover, such a cutting operation required that mechanisms be provided for insuring that material thus cut away was sufficiently removed from the recess in order to permit installation of the new packer material. Still further, provision was further required for insuring that such spent material was flushed from the preventer itself.

However, an even more serious problem with the prior technology related to the limitations in bore diameter of the resultant replacement seals which might thus be installed. More particularly, in such technology, it will be recalled that primarily it was the sealing material that was cut away from ram blocks which carried metalic pipe faces of a fixed radius of curvature and which could thus not be remotely varied during the seal member changing operation. Such pipe faces defined a portion of the cylindrical surface of the preventer rams adapted to circumscribe pipe of a diameter correlative to the radius of curvature of the pipe faces.

Accordingly, the portion of the replacement seals intended to sealing engage the outer periphery of the pipe could have a radius of curvature substantially equal to that of the pipe faces of the ram shoes in order to accomodate pipe of the same diameter sealed by the prior seal. Alternatively, the replacement seal could even have a portion intended to sealingly engage pipe having an even smaller radius of curvature to accomodate pipe of a correlative smaller o.d. than that previously sealed about by the preventer.

However, inasmuch as the radius of curvature of the metallic faces of the ram blocks could not be enlargened from a remote location, this effectively limited the ability to modify the preventer from a remote location so as to accomodate pipe having an o.d TM greater than that corresponding to this radius of curvature of the pipe faces. In other words, means were provided for remotely modifying a preventer so as to accomodate pipe o.d.'s equal to or smaller than those corresponding to the radius of curvature of the ram faces, but the pipe face o.d. of the rams first installed in the preventer when first deployed effectively limited the maximum pipe o.d. which might be accomodated and sealingly engaged by the preventer.

Still further problems were associated with prior attempts to remotely modify preventers to accomodate widely ranging pipe o.d.'s in order to sealingly engage therewith. In the removal of prior sealing material and replacement of a seal having a differing radius of curvature from a remote location, it is necessary to establish with some precision both the radial and axial position of the preventer relative to the tool performing these functions. More reliable means were sought for establishing this spatial interrelationship between the running tool relative to the preventer components. Moreover, means were also sought for more reliably and precisely establishing such radial and axial positioning of ram shoes relative to the conveying running tool both when such shoes are withdrawn from the preventer by the tool and installed within the preventer by the running tool.

Still further, a conventional replacement ram shoe adapted to replace another such shoe transported and under control from a remote location to the preventer was typically releasably attached to the ram by means of a plurality of pins and apertures in the seal and ram. When such apertures were brought in registry, they could be matingly received by such pins to releasably and retainedly interconnect the seal and the ram. Particularly in the application of the instant invention wherein it is desirable to control from a location remotely of the preventer both the removal of the prior seal as well as replacement by a new seal, the provision of such a plurality of fastening pins provided great difficulty both in effecting release of the seal from the ram block for removal as well as in reliably effecting a subsequent interconnection between the replacement seal and the ram block with the necessary integrity under the adverse conditions of the borehole environment.

Accordingly, technology was also sought in the art for providing a releasable interconnection between a ram shoe and ram block which was simpler in design and operation, reliable, and effective in controlling both such release and interconnection from a remote location.

The present invention overcomes the hereinbefore described problems as well as others, providing a novel system for effecting replacement of ram shoes in a preventer from a remote location.

SUMMARY OF THE INVENTION

In one aspect of the invention a novel ram is provided for use in pairs within a ram-type blowout preventer. Each ram has a ram block body which releasably receives one of a plurality of novel ram shoes. The ram includes means for releasably interconnecting a shoe to and disconnecting a shoe from a respective ram block body while the ram block body is disposed functionally within the preventer.

Each shoe has a shoe body defining a pair of pipe faces with half-cylindrical surfaces. A recess circumscribing the body receives a resilient seal which includes a half-cylindrical packer face surface in vertical registry with and disposed between the pipe faces. The half cylindrical surfaces of the shoes of a pair, when in opposing engagement, define a cylindrical bore therethrough for sealing engagement about the periphery of pipe. A plurality of pairs of shoes is provided, each with a different such bore adapted to engage pipe of a different o.d. when installed in a pair of ram block bodies.

Each shoe has load shoulders slidingly receivable by a mating recess within each ram block body. Means are provided for releasably interconnecting each shoe to its respective ram block body while disposed within the preventer. In a preferred embodiment such means comprises a vertical pin hole in an upper load shoulder, a vertical locking pin hole substantially centrally located in the upper surface of the ram block body, and a locking pin. When load shoulders of a shoe are within the recess of the ram block body, the holes are in vertical registry so as to receive an extractable locking pin. With the pin in place, the shoe and ram block body are integrally interconnected to form a ram of the preventer and, with the pin removed while the ram is within the preventer, the shoe may thence be removed from the ram block body and a replacement shoe installed.

The recess within the ram block body and an outer peripheral edge of the shoes are of mating general U shapes wherein the sides of the U's diverge. Sliding contact between the surfaces defining the sides of the U's as the load shoulder is slid into the ram block body recess serves as an alignment guide to insure a proper final preselected radial orientation between the shoe and its respective ram block body when installed therein.

A running tool to be disposed on a drill string and conveyed between a first location and a ram-type blowout preventer disposed at a second location is provided. The tool sequentially performs the functions of releasing an old shoe pair from ram block bodies while within the preventer in situ at the remote second location, conveying these shoes from the second to the first location, conveying replacement shoes from the first to the second location which have a bore either smaller, the same, or larger than that of the old shoe pair as desired in functional relation to the pipe o.d. to be sealingly engaged, and thence releasably installing the replacement shoes on the ram block bodies while within the preventer.

The tool comprises means for radially and vertically positioning said tool relative to said ram block bodies for said releasing and installing of said shoes; means for disconnecting said old shoes from said ram block bodies; means for releasably connecting said disconnected old shoes to said tool; means for releasably connecting said replacement shoes to said tool; and means for connecting said replacement shoes to said ram block bodies.

In a preferred embodiment, each ram block body includes in its upper surface an upper orientation slot for matingly receiving an orientation slot pin on the lower carrier flange of the tool. The tool is lowered until the slot pin contacts the upper ram block bodies which is detected at the rig floor, thereby establishing relative vertical position of the tool with respect to the ram block bodies. The tool is then rotated by the drill string until the slot pin engages the orientation slot, also detected at the rig floor, thereby establishing relative radial position of the tool with respect to the ram block bodies.

In some applications of the invention, first and second sets of rams are disposed at correlative first and second locations in known relative spatial orientation. In an alternate embodiment of the invention, positioner means on the drill string is provided in known spatial orientation relative to the running tool for determining orientation of the positioner means relative to the second set of rams. The running tool is thereby properly positioned adjacent the first set of rams for shoe installation and/or retrieval in functional response to this determined orientation of the positioner means relative to the second set of rams.

These and other features of the present invention may be better understood from the following detailed description in conjunction with the drawings, wherein:

DETAILED DESCRIPTION OF A PREFERRED EMBODIMENT

First a general description will be given of a ram type flow out preventer 60 depicted generally in FIG. 1. Next, a more detailed description of a ram assembly 10 will be given with reference to FIGS. 2–4. This will be followed by a more detailed description with reference to FIGS. 5–8 of the apparatus whereby modification of the ram assembly 10 may be effected in preventer 60 and controlled from a location remotely of the preventer 60 to accomodate pipe of varying outside diameters. Finally, this will be followed with a description of the method of use of the apparatus depicted in FIGS. 1–8 for achieving the hereinbefore recited purposes of the subject invention.

Figure 1:
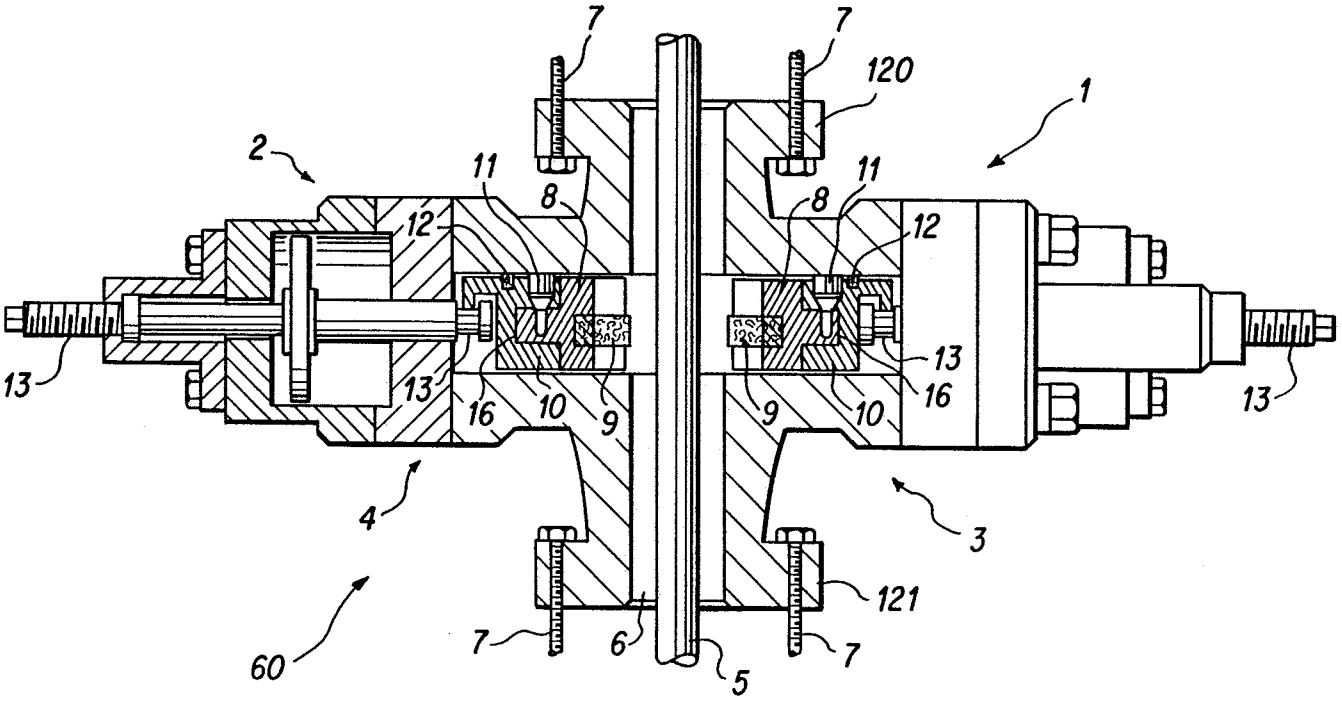
FIG. 1 is a partially sectioned front elevational view of a ram rype blow out preventer with ram assemblies thereof of the present invention withdrawn from the preventer bore.
Figure 4:
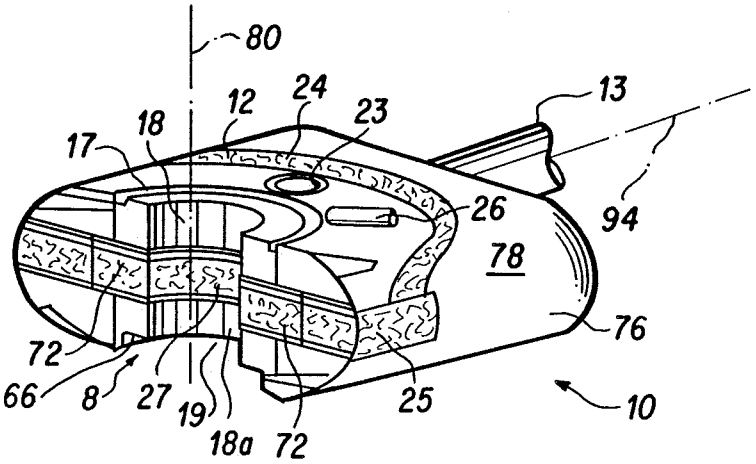
FIG. 4 is a perspective view of a ram block with a shoe of FIG. 2 wherein the shoe and block are disposed to receive the locking pin of FIG. 3.

First, with respect to FIG. 1, a preventer is shown employing the novel ram assemblies 10 of the present invention shown in FIG. 4. The typical preventer 60 is secured to other preventers and the wellhead by means of bolts 7. Extending through the pressure housing of the preventer 60 is a bore 6 for purposes of providing fluid communication through the preventer along the borehole, as well as for permitting pipe 5 ,used for various purposes known in the art and having varying outside diameters, to extend therethrough. In general, the preventer includes a pair of opposing ram assemblies 10 which may be urged radially inwards into and outwards from the bore 6.

Although the ram assemblies 10 will be described in greater detail with reference to FIGS. 2–4, for present purposes it will be appreciated that each assembly includes a resilient member providing a semicircularly curved packer surface portion 27. When the ram assemblies 10 are urged radially inwards by hydraulic or mechanical actuating means 1 and 2 through thrust rods 13 having longitudinal axes 94, these packer surfaces 27 will sealingly and matingly engage about the outer circumferential periphery of the pipe 5. Additionally, radially inward portions of the packets 27 on sealing surface 9 will engage one another whereby such sealing engagement in combination with the portions of the ram assemblies 10 extending into the bore 6 will effectively seal off vertical fluid flow and pressure differentials within the bore 6. It is conventional in the art to provide top and side seals 12 and 25, respectively, for purposes of sealing off the area between the outer periphery of the ram assembly and the bore in the preventer housing through which the assemblies travel. Thus flow is prevented between the bore 6 and portions of the preventer 60 radially outwards of the ram assemblies 10 and the bore through which they travel.

Figure 3:
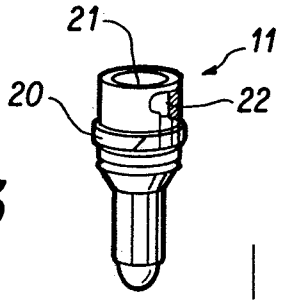
FIG. 3 is a partially sectioned perspective view of a lock pin for releasably securing the shoe within the preventer to a ram block.
Figure 2:
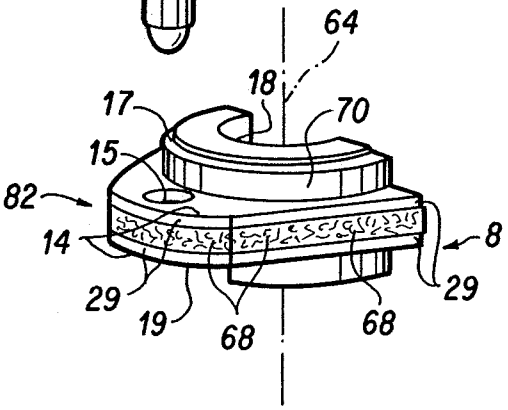
FIG. 2 is a pespective view of a ram shoe according to the invention.

With reference now to FIGS. 2–4, a novel ram shoe 8 of FIG. 2, locking pins 11 of FIG. 3, and block body 76 with ram shoe 8 of FIG. 4 of the present invention may be seen illustrated. For purposes herein when the shoe 8 of FIG. 2 is installed in the body 76 as shown in FIG. 4 with or without the locking pin 11, such assembly may be variously referred to herein as the ram assembly 10 or for purposes of convenience, "rams".

First, with respect to FIG. 2, the shoe 8 depicted therein may be seen as having a shoe body 70 of metallic or like strong and durable material and a seal 82. The shoe body 70 includes a pair of load shoulders 14 and a pair of semicircular pipe faces 18 and 18*a*, the body further defining a seal receiving recess which circumscribes the body and carries a seal 82 disposed therewithin of a resilient material. The upper and lower shoulders have respective upper and lower shoulder surfaces which are substantially flat and lie in corresponding parallel planes which are normal to a shoe body vertical axis of symmetry 64. It will be noted that the shoe is of a generally symmetrical configuration about this axis. A pin hole 15 extends into, but not through load shoulder 14.

With more particular reference to the seal 82, in a preferred embodiment, it will in part be comprised of an inside seal portion for mating and sealing engagement with portions of the block body 76 defined by an internal recess therein of the same general U shape defined by the combination of the outer surface 68 of the inside seal portion 16 and the outer edges 29 of the load shoulders 14, the latter two being referred to collectively as a surface means. The block body is generally symmetrical about its vertical axis 80. By providing mating U shapes of the recess in the block body 76 and the outer peripheral edge or surface means of the shoe, proper radial positioning and alignment of the shoe relative to the body is insured during insertion of the shoe into the body 76. More particularly, the two sides of these respective U shapes preferably are substantially flat and diverge outwards, i.e. are non-parallel.

With reference to FIG. 4, the seal 82 will further comprise the curved packer surface portion 27 intended to engage the outer periphery of the pipe 5 and a generally flat packer portion 72 intended to engage a like portion of the opposing ram assembly 10. The radius of curvature of the pipe faces 18 and 18*a* is preferably substantially the same as that defining the curved packer surface portion 27. The pipe faces 18 and 18*a* and curved packer surface portions 27 may thereby in vertical registry form a generally semicircular half-cylinder shape of the same approximate radius of curvature of the pipe 5 about which the ram assemblies 10 are to seal.

It is contemplated by the present invention to provide a plurality of shoe pairs (individual shoes of which are of the form shown in FIG. 2) whereby when the shoes of each pair are disposed in opposing relation in contact, each pair defines a bore therethrough of a predetermined diameter for receiving pipe of a corresponding o.d. More particularly, the bore diameter of a particular pair will be defined by the radius of curvature of the pipe faces and curved packer surface portions (which are preferably substantially equal) of the shoes comprising the pair.

A pair of ram shoes 8 will be provided for each o.d. of pipe to be sealingly engaged by the preventer wherein the bore and radius for each such shoe pair will be functionally related to the o.d. of the pipe for which it is provided and intended to seal about. The remainder of each ram assembly when a shoe is removed is of a universal design and thus adapted so as to receive in the manner shown in FIG. 4 any such shoe. The shoe of a ram assembly of the present invention may thus be replaced or interchanged with any remaining shoe of the plurality of pairs.

In this manner to sealingly engage pipe of a given o.d., an appropriate particular pair of shoes 8 from the plurality of shoe pairs may be selected corresponding to this o.d. Shoes previously in place in each ram assembly of the preventer are removed and replaced with respective ones of the selected replacement shoes whereby ram assemblies 10 are thereby created which are custom fit to accomodate any desired o.d. pipe 5.

As aforestated, it is a further feature of the invention to provide a system for remotely controlling the replacement of such pairs of shoes within the preventer while the block bodies 76 are present therein, thereby accomodating any desired pipe o.d.

With further reference to FIG. 4, it will be noted that a holding pin recess 17 may preferably be provided in the upper portion of the shoe body 70. The purpose of this recess is generally to insure that when a shoe is retrieved from a block body 76 it is securely and retainedly held by the running tool of the present invention when this shoe is transported away from the preventer and conversely to insure that a new replacement shoe will, in like manner, be reliably retained by the running tool as it is being transported from a remote location to the preventer for subsequent installation in the ram block body 76.

A lock pin hole 23 will also be disposed vertically within the block body 76 in such a manner that when the shoe 8 is in mating engagement with the block body to form the ram assembly 10, this lock pin hole 23 and pin hole 15 of the shoe will be in vertical registry so as to receive the lower portion of the lock pin 11 of FIG. 3.

Also with respect to FIG. 4, an orientation slot means 26 is provided in the upper surface 78 of the block body 76. In general the purpose of this slot is to establish a desired preselected radial orientation of the running tool relative to the block bodies when disposed in the preventer housing. Further with reference to FIGS. 2 and 4, a guide slot 66 is provided in the lower portion of the shoe body 70. The purpose of slot 66 is to insure proper radial positioning of each shoe as it is being disposed onto the running tool for removal from the preventer to the remote location and, conversely, to insure again such proper radial positioning of a new replacement shoe with respect to the running tool during removal of the shoe from the running tool for installation at a remote location of the shoe within the block body 76. The guide slot 66 may preferably form a portion of a conventional mud slot 19 also disposed in the lower surface of the shoe and traversing the block body 76 which is used for conventional purposes well known in the art.

Regarding the locking pin 11 depicted in FIG. 3, from the sectional wall view portion thereof, an annular collet shoulder 22 may be seen defining a portion of the collet hole 21 disposed axially in the upper portion of the pin. Further, a snap ring 20 will be provided about the outer periphery of the upper portion of the pin 11. The purposes of such collet hole, snap ring, and shoulders will be hereinafter described with reference to the overall operation of the system.

Figure 5:
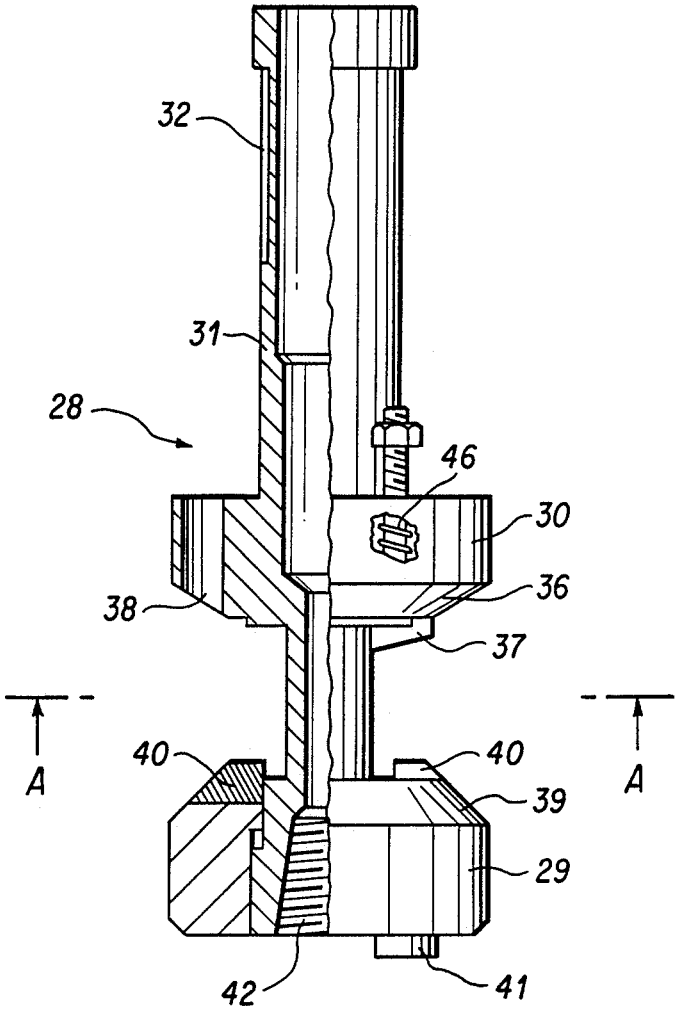
FIG. 5 is a partially sectioned front elevational view of a ram shoe carrier according to the invention.
Figure 6:
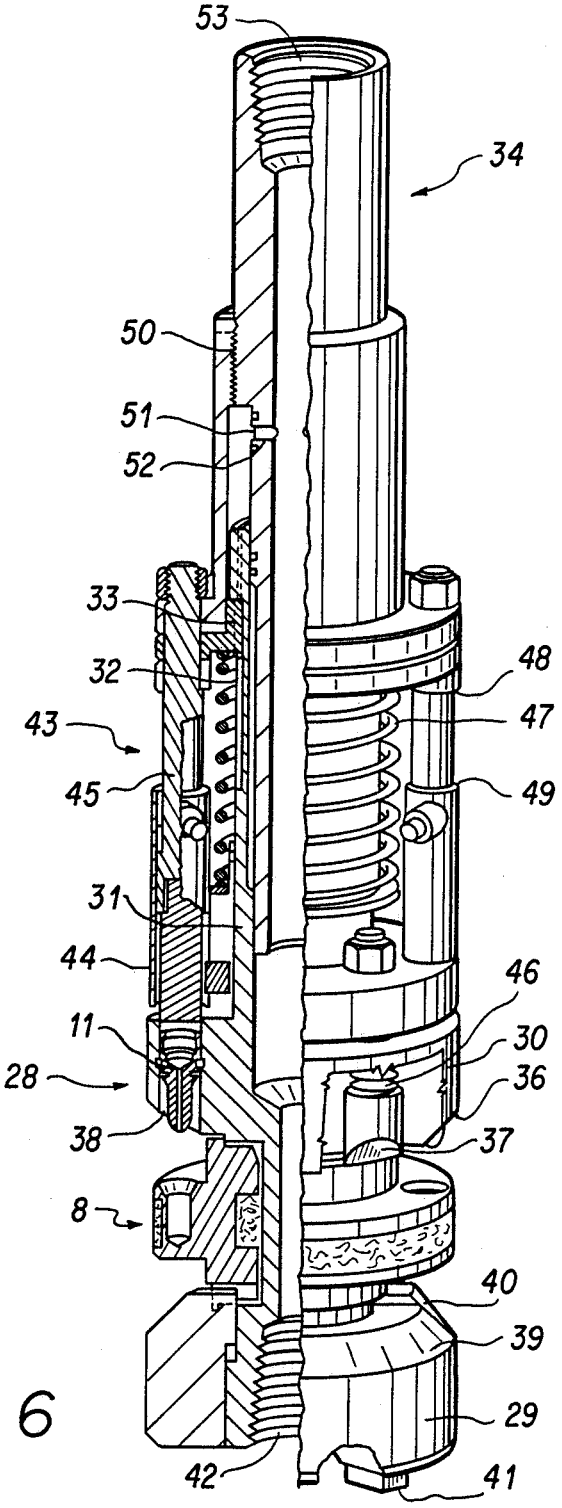
FIG. 6 is a partially sectioned front elevational view of the running tool assembly of the present invention including the ram shoe carrier of FIG. 5 with two shoes of FIG. 2 and two locking pins of FIG. 3 prior to installation of the shoes in the preventer of FIG. 1.
Figure 9:
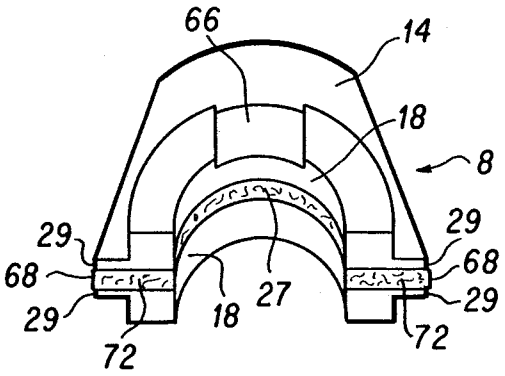
FIG. 9 is a perspective view of the underside of the ram shoe of FIG. 2.

With reference now to FIG. 5, a ram shoe carrier 28 is shown depicted therein generally which forms a portion of the assembled running tool of FIG. 6. The basic purpose of the carrier 28 is to carry away from the preventer a first pair of shoes already disposed within the preventer to a remote location and to further transport a replacement pair of shoes (such as those defining in combination a sealing bore different from that of the pair of shoes thus removed) to the preventer for installation in response to remote control actions transmitted through the drill string and running tool.

Accordingly, it will be appreciated that such a carrier 28 must be designed whereby these shoes may be (1) securedly affixed to the running tool when it is desired to transfer them away from and into the preventer while at other times the shoes must be (2) readily, easily, and reliably released from the running tool for installation in the preventer. Moreover, such a carrier 28 must further provide the function of (1) easily and reliably removing the locking pins 11 from the prior ram assemblies 10 while disposed in the bore of the preventer so as to release these shoes from the ram bodies for removal by the carrier while at other times providing the function of (2) installing the locking pins within the locking pin holes and pin holes of the ram body and shoe when in mating vertical registry to rigidly secure the new replacement shoes to their respective block bodies.

Figure 8:
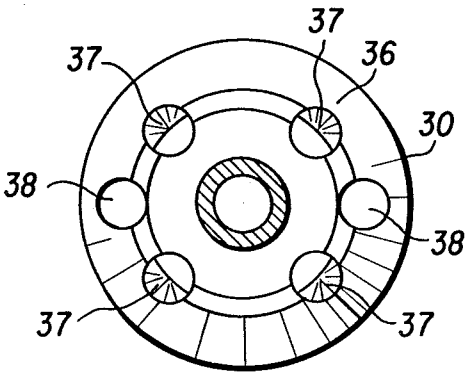
FIG. 8 is a sectioned plan view taken along line A—A of the shoe carrier of FIG. 5 illustrating the position of the lock pin guides, holding pins and taper leads of the upper carrier flange.

FIG. 8, a sectional view through the ram face carrier 28 of FIG. 5, illustrates the upper carrier flange 30 with the relative positions of the tapered holding pins 37 and locking pin guides 38 depicted Thus, with continued reference to FIG. 5, a lower carrier flange 29, upper carrier flange 30, and carrier sleeve 31 are provided. The carrier sleeve 31 has a keyway 32 to engage a key 33 shown in FIG. 6 for purposes to be hereinafter described. The upper carrier flange 30 has a tapered lead 36 and the previously mentioned spring-loaded holding pins 37, and locking pin guides 38. The lower carrier flange, in like manner to the upper flange, has a taper face 39 interupted by a radial guides 40, orientation slot pins 41, and pipe thread 42 from which guide pipe is suspended below the running tool. The purpose and operation of these components will be made more clear with reference to discussion hereinafter of the running tool itself.

Referring now to the running tool as depicted in FIG. 6, it will be recalled that it is disposed on the end of a drill pipe string by means of threads 53 and the ram shoe carrier of FIG. 5 may be seen as a component thereof. It will further be recalled that the basic purpose of the running tool is to release a first set of shoes from ram block bodies while within a preventer, to afix such released shoes reliably to the running tool and thus transport them away from the preventer to a remote location. Yet a further purpose of the running tool is to transport a new replacement set of shoes from this remote location to the preventer and to install such shoes in these same ram blocks. A pair of block pin inserter-/extracter assemblies 43 and the ram shoe carrier 28 of FIG. 5 are carried by a mandrel 34. In this view, each inserter/extracter assembly 43 is equiped with a pin plunger 44 installed in an actuating plunger 45 for insertion of a lock pin 11 into the lock pin hole 23 and pin hole 15 of the ram assembly 10 in FIG. 4.

The inserter/extractor assembly 43 contains a restraining spring 47 to bias the running tool assembly in the extended position depicted in FIG. 6. Upper and lower stops 48 and 49 are included to limit the travel of the inserter/extractor assembly 43 when the restraining spring 47 is compressed and relaxed in response to vertical movement of the drill string as will be hereinafter described. The mandrel 34 is attached to the inserter-/extracter assembly 43 by threads 50. A key 33 on the inserter/extracter assembly 43 slidingly received by keyway 32 insures that the assembly 43 may move in the direction of the longitudinal axis of the running tool while preventing rotational movement about the tool. The mandrel 34 further contains signal ports 51 and chevron seals 52 to attach to the drill pipe that positions and operates the running tool. Four spring-loaded tapered holding pins 37 are provided disposed about the longitudinal axis of the running tool, and the pin springs 46 provide spring biasing for each of the pins 37.

Figure 7:
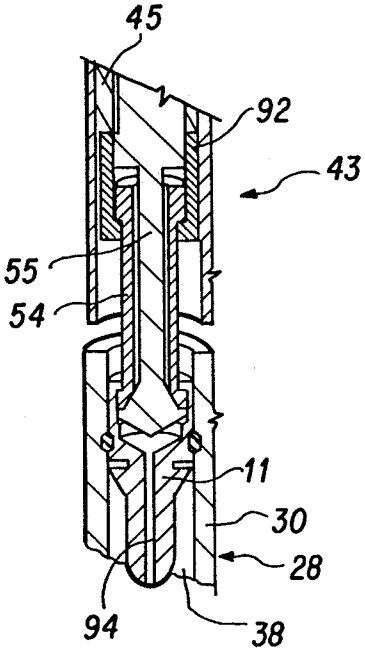
FIG. 7 is an enlarged sectioned front elevational view of a portion of the running tool of FIG. 6 depicting a portion of one of the lock pin inserter/extractor assemblies thereof and further illustrating a lock pin of FIG. 2 after removal from the preventer of FIG. 1 and ram block and shoes of FIG. 4.

Referring to FIG. 7, this is an enlarged sectioned view of the upper carrier flange and that portion of the inserter/extractor 43 containing the actuating plunger 45. The inserter/extractor assembly provides a dual function. In the installation mode wherein shoes are about to be installed (as shown in FIG. 6) the running tool has a pin plunger 44 provided in each assembly 43 for moving a corresponding pin 11 downwards into the mating holes once the block bodies 76 are brought radially inwards to engage the shoes 8 carried by the tool. However in the configuration shown in FIG. 7 the assemblies 43 are adapted to a retrieval mode for extracting such pins from the block bodies to release the old shoes onto the running tool which will be hereinafter described.

Obviously, in this retrieval mode, the shoes 8 shown in FIG. 6 will be omitted from the running tool to provide room for the shoes about to be extracted from the preventer and transferred to a remote location. Further regarding this latter retrieval mode for withdrawing the old shoes, the pin plunger 44 is not employed. Rather the apparatus of FIG. 7 is substituted in the inserter/extracter assemblies 43 of the running tool. More particularly, a sleeve 92 is inserted adjacent the actuating plunger 45 and a collet plunger 55 is substituted for the pin plunger 44. Moreover, a spring collet 54 is further provided. In operation, to extract a pin 11 from a ram assembly 10, when the plunger 55 is moved downwards by downward movement of the running tool in a manner to be described, the lower conically shaped portion of the collet plunger 55 and lower portion of the spring collet 54 are thereby inserted into the collet hole 21 of FIG. 1 of the lock pin 11. Moreover, the shoulder of the collet pin 55 contacting the spring collet 54 causes the lower portion thereof to expand radially outwards into the portion of the collet hole 21 below the collet shoulder 22. Thereafter, upon subsequent upward movement of the collet plunger and running tool, the lower conical portion of the plunger 55 moves axially upwards past the collet shoulder 22 to retain the lower portion of the collet spring below the shoulder 22 whereby the plunger 55, spring collet 54, and locking pin 11 may thereafter be moved vertically upwards in integral relation so as to extract pin 11 from the pin holes 23 of the ram assembly 10, thereby permitting release of the shoe from its block body 76 and subsequent removal therefrom onto the running tool.

It will be noted in FIGS. 6 and 7 that the locking pin preferrably has a vertical passageway 94 extending axially therethrough communicating with the collet hole 21. In operation, it is preferable when a locking pin is installed in the assembly 43 for subsequent insertion into a remotely located preventer, to fill this collet hole with an appropriate extrudable material such as silicon grease or the like. Foreign debris such as drill cuttings are thereby prevented from lodging in the collet hole and thereby clogging it to impair subsequent pin removal. However, in the pin extraction procedure just described, when a locking pin has been previously installed in a ram assembly with this grease or like material, during the extraction procedure the purpose of the passage 94 may be appreciated. In response to the collet plungers 55 entering respective collet holes 21 in pins 11 to effect extraction, such grease material will be forced through passages 94 and upwards in the space between the locking pins 11 and the walls defining respective pin holes 15 and lock pin holes 23 through which the pins extend.

In the previously described embodiment of the running tool of the present invention relative radial and vertical positioning of the running tool and shoes and lock pins 11 carried thereby was accomplished in part by the tool being lowered until the orientation slot pin 41 contacted the upper surface 78 of the ram block body 76, and thereafter engaged the orientation slot means 26 on the upper surface 78 after rotation of the running tool. However, in some applications which will now be described it may be desirable to establish such proper positioning of the running tool in functional relation to a lower surface of a ram block body.

In typical offshore drilling operations it is conventional to provide a pair of preventers vertically aligned so as to form a "stack" as it is known in the art. Each such preventer is typically a double ram preventer such as that depicted on page 1436 of the 1980–1981 Composite Catalog published by World Oil and manufactured by Cameron Iron Works. A double ram preventer has two sets of opposing rams within a pressure housing with one set positioned above the other in contrast to the single ram preventer depicted in FIG. 1. However, as with the preventer of FIG. 1 having upper and lower flanges 120 and 121, respectively, for interconnection to other preventers in vertical alignment, these double ram preventers are also provided with upper and lower flanges for the same reason.

Figure 11:
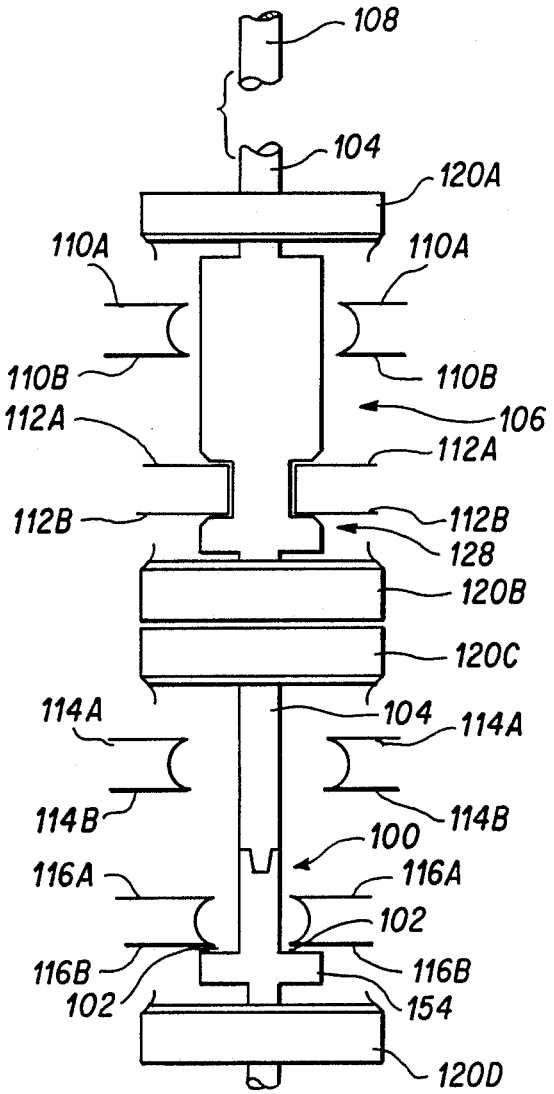
FIG. 11 is a pictorial and schematic view of a typical subsea blowout preventer stack consisting of two double ram preventers illustrating one mode of use of the assembly of FIG. 9 and a running tool in accordance with the present invention wherein the tool is positioned for use with the bottom preventer and with the assembly of FIG. 10 engaging one of the middle sets of rams.
Figure 12:
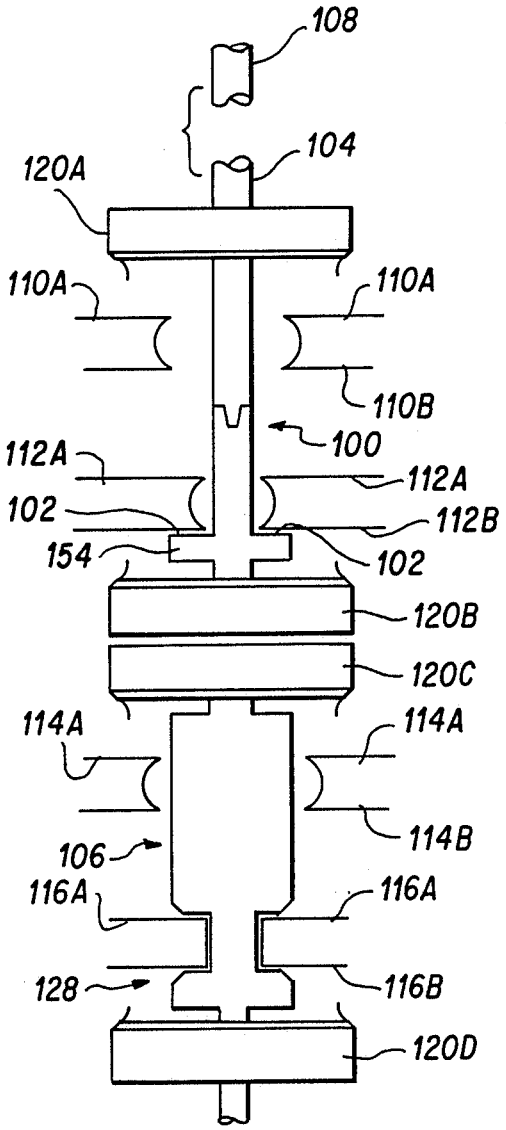
FIG. 12 is a pictorial and schematic view of the preventer stack of FIG. 11 illustrating another mode of use of the assembly of FIG. 9 and a running tool in accordance with the present invention wherein the too is positioned for use with the middle preventer and with the assembly of FIG. 10 engaging the bottom set of rams.

Referring briefly to FIGS. 11 and 12, a typical such offshore stack is depicted therein schematically. The stack consists of an upper double ram preventer (having upper and lower flanges 120A and 120B similar to flanges 120 and 121 of the single ram preventer of FIG. 1) and a lower double ram preventer (having upper and lower flanges 120C and 120D also similar to flanges 120 and 121 of FIG. 1).

For purposes of clarity and simplicity in the preventers depicted in FIGS. 11 and 12 the typical components of ram preventers such as those shown in FIG. 1 have been omitted with the exception of the vertically stacked pairs of rams therewithin. Each double ram preventer of FIGS. 11 and 12 will include two such pairs of rams, such as the ram pair 110A and ram pair 112 A with respect to the upper preventer and ram pair 114A and ram pair 116A with respect to the lower preventer.

With respect to such preventer stacks, it is conventional to know with great precision the relative spatial positioning of each double ram preventer and its correlative components such as rams 110A–112A with respect to remaining such preventers and components of the stack such as rams 114A–116A. In this manner a desired radial and vertical position within a pair of rams of a given preventer may be referenced from a known position in or on another preventer or component thereof such as another pair of rams within a different preventer.

Moreover, in certain applications such as the aforesaid offshore environment, it may be desirable to replace shoes of one ram pair of one of the preventers by means of the hereinbefore described running tool wherein it is properly positioned vertically and radially within the pair of such preventer by means of reference to position of another preventer in the stack and, more particularly, with reference to the lower surface of one of the ram pairs therein.

A typical reason for this is as follows. In such offshore applications involving a floating drilling rig, motion of the seas causes the rig and drill pipe to move to such a degree that positioning of the running tool of FIG. 6 on the top of rams, as previously described with reference to FIGS. 1–9, becomes difficult. In this situation it is preferrable to utilize the conventional rig motion compensator of the floating drilling rig to stabilize and position the running tool with relation to the preventer rams wherein ram shoes are to be replaced. This compensator will limit the upward and downward movement of the drill string relative to the preventers and the rig. Due to the operation of such compensators, however, it is preferable to establish as a point of reference for shoe replacement according to the invention a location on the lower surface of the ram assemblies.

Figure 10:
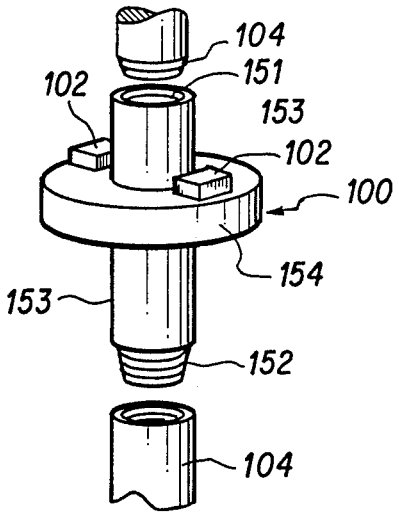
FIG. 10 is a perspective view illustrating a positioner sub assembly for use in the drill string with and either above or below the running tool of the present invention to establish vertical and radial positioning thereof with respect to rams in need of shoe replacement.

Referring to FIG. 10 a positioning sub or donut 100 may be provided disposable from sections of guide pipe 104 and to be connected to a running tool 106 of the present invention (such as that of FIG. 6) in a manner as shown in FIG. 11. The donut-tool combination, in turn, will be disposed from the drill string 108. The donut 100 will preferably include a positioner flange 154 having an upper surface 101 upon which are disposed one or more positioning lugs 102. Positioner pipe 153 will be provided with upper and lower threads 151 and 152, respectively, for facilitating interconnection of the donut 100 to the running tool 106 and guide pipe 104.

Figure 13:
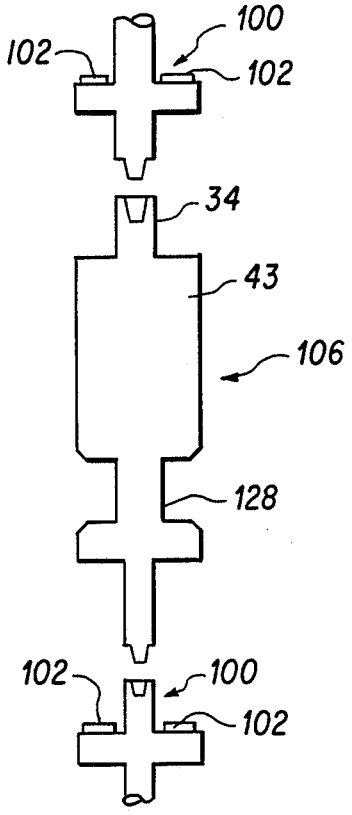
FIG. 13 is a schematic representation of the running tool of FIG. 6 and assembly of FIG. 10 illustrating interconnectnion of the assembly to either the top or bottom of the tool.

The double 100 may be positioned by threaded connection alternatively as shown in FIG. 13 so as to be either below or above the running tool 106. For use in the application shown in FIG. 11 wherein it is desired to replace shoes in the upper preventer by positioning the running tool 106 therein with reference to a location within the lower preventer, the donut 100 will be placed below the running tool 106. Conversely, for the application shown in FIG. 11 wherein it is desired to replace shoes in the lower preventer by positioning the running tool 106 therein with reference to a location within the upper preventer, the donut 100 will be place above the running tool 106.

Regarding FIG. 11, the relative radial and vertical position of mud slots 19 and guide slots 66 in the lower surface 116B of the rams 116A of the lower preventer may be previously known from the stack relative to a vertical and radial position between the rams 112A of an upper preventer. This latter position is that which is desired for proper positioning of the running tool 106 within the upper preventer and proper positioning of the ram face carrier 128 within the rams 112A in order to install and retrieve shoes thereby.

The donut 100 and running tool 106 may be disposed on the drill string 108 and guide pipe 104 in this same desired spatial positioning. Thus when the donut 100 is positioned in a know manner relative to the lower surface 116B of the rams 116A of the lower preventer, it necessarily follows that the running tool 106 and ram shoe carrier 128 will be thereby also positioned in the aforesaid desired position between the rams 110A and 112A, respectively, of the upper preventer necessary for the shoe changing operation (both retrieval and installation).

The manner of thus positioning the donut 100 in the desired known and preselected vertical and radial position relative to this lower surface 116B of rams 116A within the lower preventer will now be described in greater detail with reference to FIG. 11 wherein there may be seen depicted a simplified pictorial illustration of such a donut 100 disposed on a length of guide pipe 104. The orienting tabs 102 of the donut 100, in co-operation with the mud slot 19 portions and guide slots 66 of the lower surfaces 110B–116B of the rams 110–116, operate in a similar manner and for a similar purpose to the co-action between the orientation slot pin 41 on the running tool of FIG. 6 and the orientation slot means 26 disposed in the upper surface of the ram 10 of FIG. 4 as previously described.

More particularly, as shown for example in FIG. 11, the drill string 108 is moved upwards until contact of the donut 100 and the lower surface 116B of rams 116A of the lower preventer is detected at the rig floor. The donut 100 is thence rotated by means of the drill string 108 until the tabs 102 engage and are co-aligned with the mud slot 19 portions and guide slots 66 of the lower surfaces 116B of these rams 116B. Such engagement may be detected on the rig floor inasmuch as it will prevent further rotation of the drill string 108.

Due to the aforementioned proper placement of the running tool radially and vertically on the drill string 108 relative to the donut 100 on the guide pipe 104, the running tool 106 will thereby be properly placed radially and vertically between the rams 110A of the preventer for shoe installation or removal as shown in FIG. 11 in the manner of the invention described with respect to FIGS. 1–8. In like manner, the ram shoe carrier 128 will be properly disposed between the rams 112A of the upper preventer which carry the shoes to be replaced.

In other situations such as that depicted in FIG. 12 it is desirable to establish proper vertical and radial positioning of the running tool 106 in a lower preventer for which shoe replacement is desired in relation to a known location on another preventer which is disposed in the stack above the lower preventer. In this case, as illustrated in FIG. 12, the orienting donut 100 will be disposed from the drill pipe 108 in a manner so as to be above the running tool 106 and within the upper preventer which is above the lower preventer in which the running tool is to be disposed for shoe replacement.

Movement of the drill string 108 upwards will cause the donut 110 to initially engage the lower surface 112B of the rams 112A of the upper preventer . Rotation of the drill string 108 will thence cause engagement of the tabs 102 on the upper surface 101 of the donut 100 in registry with correlative mut slot 19 portions and the guide slots 66 of the lower surfaces 112B of the rams 112A. In this manner proper radial and vertical positioning of the running tool 106 and ram shoe carrier 128 between the rams 114A and 116A, respectively, of the lower preventer is thereby established for subsequent shoe retrieval or installation in accordance the teachings of the present invention.

It is apparent that the present invention is one well adapted to obtain all of the advantages and features hereinnabove set forth, together with other advantages which will become obvious and apparent from a description of the apparatus itself. It will be understood that certain combinations and subcombinations are of utility and may be employed without reference to other features and subcombinations. Moreover, the foregoing disclosure and description of the invention is only illustrative and explanatory thereof, and the invention admits of various changes in the size, shape, and material composition of its components, as well as in the details of the illustrated construction, without departing from the scope and spirit thereof.

I claim:

1. A ram assembly for use in a ram type blow out preventer, comprising:

a thrust rod defining a longitudinal axis;

a ram block body interconnected to said rod and defining a vertical cylindrical lock pin hole having a vertical axis intersecting and normal to said longitudinal axis of said thrust rod;

a ram shoe preselected from a plurality of parts thereof having different bores, said shoe having a load shoulder with a vertical cylindrical pin hole extending through said shoulder, and further having pipe faces and a seal disposed between said pipe faces and circumscribing said shoe; and a lock pin means having a collet hole disposed in one end for releasably interconnecting said ram shoe and said ram block when said lock pin means, said lock pin hole, and said pin hole are coaligned in vertical registry with said lock pin means disposed in said lock pin hole and said pin hole.

2. A method using a running tool suspended from a drill hole string for changing from a first location a pair of ram shoes releasably interconnected by pins to respective rams of a ram type blow out preventer, comprising the steps of:

closing said rams;

lowering said drill string until said running tools and said rams establish a point of contact;

rotating said drill string to determine the relative radial position of said running tool with respect to said rams;

re-positioning said drill string to a predetermined distance from said contact point until said rams are disposed radially about said running tool;

closing said rams about said running tool in an amount sufficient for said shoes to be retained by said running tool;

re-positioning said drilling string in an amount sufficient for said running tool to engage said pins;

re-positioning said drilling string in an amount sufficient for said running tool to extract said pins from said respective rams and to retain said pins with said running tool, thereby releasing said shoes from said rams.

3. A running tool disposable on a drill string for retrieving and installing shoes releasably interconnected by pins to rams of a ram-type blowout preventer from a remote location, comprising:

means for determining spatial orientation of said tools relative to said preventer for said retrieving and installing of said shoes:

means for extracting and replacing said pins; and means for releasably retaining said shoes on said tool after said pins are extracted and while said pins are being replaced.

* * * * *